US007768478B2

(12) United States Patent
Cho et al.

(10) Patent No.: US 7,768,478 B2
(45) Date of Patent: Aug. 3, 2010

(54) PLASMA DISPLAY APPARATUS

(75) Inventors: Janghwan Cho, Seoul (KR); Hyunil Park, Seongnam-si (KR); Changjoon Park, Seoul (KR); Sunghwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 556 days.

(21) Appl. No.: 11/837,353

(22) Filed: Aug. 10, 2007

(65) Prior Publication Data

US 2008/0036390 A1 Feb. 14, 2008

(30) Foreign Application Priority Data

Aug. 10, 2006 (KR) ..... 10-2006-0075908

(51) Int. Cl.
*G09G 3/28* (2006.01)

(52) U.S. Cl. ..... 345/66; 345/63

(58) Field of Classification Search ..... 345/60, 345/63, 66; 315/169.4
See application file for complete search history.

(56) References Cited

U.S. PATENT DOCUMENTS 4,091,309 A * 5/1978 Strom ..... 345/58
2001/0054994 A1 12/2001 Hsu et al.
2004/0207332 A1 10/2004 Cho et al.
2007/0013617 A1* 1/2007 Moon ..... 345/67

FOREIGN PATENT DOCUMENTS

| | | | |
|---|---|---|---|
| EP | 0704834 | A1 | 4/1996 |
| EP | 1227464 | A2 | 7/2002 |
| EP | 1542200 | A2 | 6/2005 |
| JP | 11-344948 | A | 12/1999 |
| KR | 2002-0094713 | A | 12/2002 |
| KR | 10-2005-0041716 | A | 5/2005 |
| KR | 10-0588019 | B1 | 6/2006 |

* cited by examiner

*Primary Examiner*—Ricardo L Osorio
(74) *Attorney, Agent, or Firm*—Birch, Stewart, Kolasch & Birch, LLP

(57) ABSTRACT

A plasma display apparatus is disclosed. The plasma display apparatus includes a plasma display panel including a first electrode and a second electrode connected to a reference voltage source, a negative voltage controller that supplies a negative voltage output from a negative constant voltage source to the first electrode, a sustain driver, and a negative voltage blocking unit. The sustain driver supplies a sustain signal to the first electrode, and one terminal of the sustain driver is connected to one terminal of the negative voltage controller. The negative voltage blocking unit prevents the negative voltage from being supplied to the reference voltage source through the sustain driver while the negative voltage controller supplies the negative voltage to the first electrode.

16 Claims, 5 Drawing Sheets

PLASMA DISPLAY APPARATUS

This application claims the benefit of Korean Patent Application No. 10-2006-0075908 filed on Aug. 10, 2006, which is hereby incorporated by reference.

BACKGROUND OF THE DISCLOSURE

1. Field of the Disclosure

This document relates to a plasma display apparatus.

2. Description of the Related Art

A plasma display apparatus generally includes a plasma display panel displaying an image, and a driver attached to the rear of the plasma display panel to drive the plasma display panel.

The plasma display panel has the structure in which barrier ribs formed between a front substrate and a rear substrate thereof form unit discharge cell or discharge cells. Each discharge cell is filled with an inert gas containing a main discharge gas such as neon (Ne), helium (He) or a mixture of Ne and He, and a small amount of xenon (Xe). The plurality of discharge cells form one pixel. For instance, a red (R) discharge cell, a green (G) discharge cell, and a blue (B) discharge cell form one pixel.

When the plasma display panel is discharged by a high frequency voltage, the inert gas generates vacuum ultraviolet rays, which thereby cause phosphors formed between the barrier ribs to emit light, thus displaying an image. Since the plasma display panel can be manufactured to be thin and light, it has attracted attention as a next generation display device.

SUMMARY OF THE DISCLOSURE

In one aspect, a plasma display apparatus comprises a plasma display panel including a first electrode and a second electrode connected to a reference voltage source, a negative voltage controller that supplies a negative voltage output from a negative constant voltage source to the first electrode, a sustain driver that supplies a sustain signal to the first electrode, one terminal of the sustain driver being connected to one terminal of the negative voltage controller, and a negative voltage blocking unit that prevents the negative voltage from being supplied to the reference voltage source through the sustain driver while the negative voltage controller supplies the negative voltage to the first electrode.

The reference voltage source may supply a ground level voltage.

The sustain driver may include a capacitor, supply a first voltage to the first electrode and one terminal of the capacitor, and supply a second voltage of the other terminal of the capacitor to the second electrode. The second voltage may be lower than the first voltage, and the first voltage and the second voltage may have different polarities and a substantially equal voltage magnitude.

The negative voltage controller may include a set-down controller that supplies a set-down signal gradually falling to the negative voltage to the first electrode during a set-down period.

The negative voltage controller may include a scan signal controller that supplies a scan signal falling to the negative voltage to the first electrode during an address period.

The plasma display apparatus may further comprise a setup controller that supplies a setup signal gradually rising from the first voltage to a voltage level equal to two times a magnitude of the first voltage to the first electrode.

The negative voltage blocking unit may block the current flow from the other terminal of the capacitor into one terminal of the capacitor.

In another aspect, a plasma display apparatus comprises a plasma display panel including a first electrode and a second electrode connected to a reference voltage source, a negative voltage controller that supplies a negative voltage output from a negative constant voltage source to the first electrode, a first sustain controller that controls to supply a first voltage to the first electrode and one terminal of a capacitor, an inductor unit that generates resonance between the plasma display panel and the inductor unit, a resonance controller that swings a voltage level of the first electrode between the first voltage and a second voltage lower than the first voltage through resonance between the plasma display panel and the inductor unit, a second sustain controller that controls to supply the second voltage of the other terminal of the capacitor to the first electrode, a reverse current blocking unit that is electrically connected to the inductor unit and the resonance controller, and blocks a reverse current, and a negative voltage blocking unit that the negative voltage supplied to the first electrode from being supplied to the reference voltage source through the capacitor.

The reference voltage source may supply a ground level voltage.

The first voltage and the second voltage may have different polarities and a substantially equal voltage magnitude.

The plasma display apparatus may further comprise a voltage maintenance unit that blocks a reverse current to maintain a voltage charged to the capacitor constant.

The resonance controller may include a first resonance switch operated so that a voltage level of the first electrode changes from the first voltage to the second voltage, and a second resonance switch operated so that a voltage level of the first electrode changes from the second voltage to the first voltage.

The inductor unit may include a first inductor that generates resonance between the plasma display panel and the first inductor so that a voltage level of the first electrode changes from the first voltage to the second voltage, and a second inductor that generates resonance between the plasma display panel and the second inductor so that a voltage level of the first electrode changes from the second voltage to the first voltage.

The reverse current blocking unit may include a first diode that blocks the current flow from the inductor unit into the first electrode, and a second diode that blocks the current flow from the first electrode into the inductor unit.

The negative voltage blocking unit may include a diode having an anode terminal connected to one terminal of the capacitor.

The negative voltage blocking unit may include a diode having a cathode terminal connected to the other terminal of the capacitor.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Embodiments will be described in a more detailed manner with reference to the attached drawings.

Figure 1:
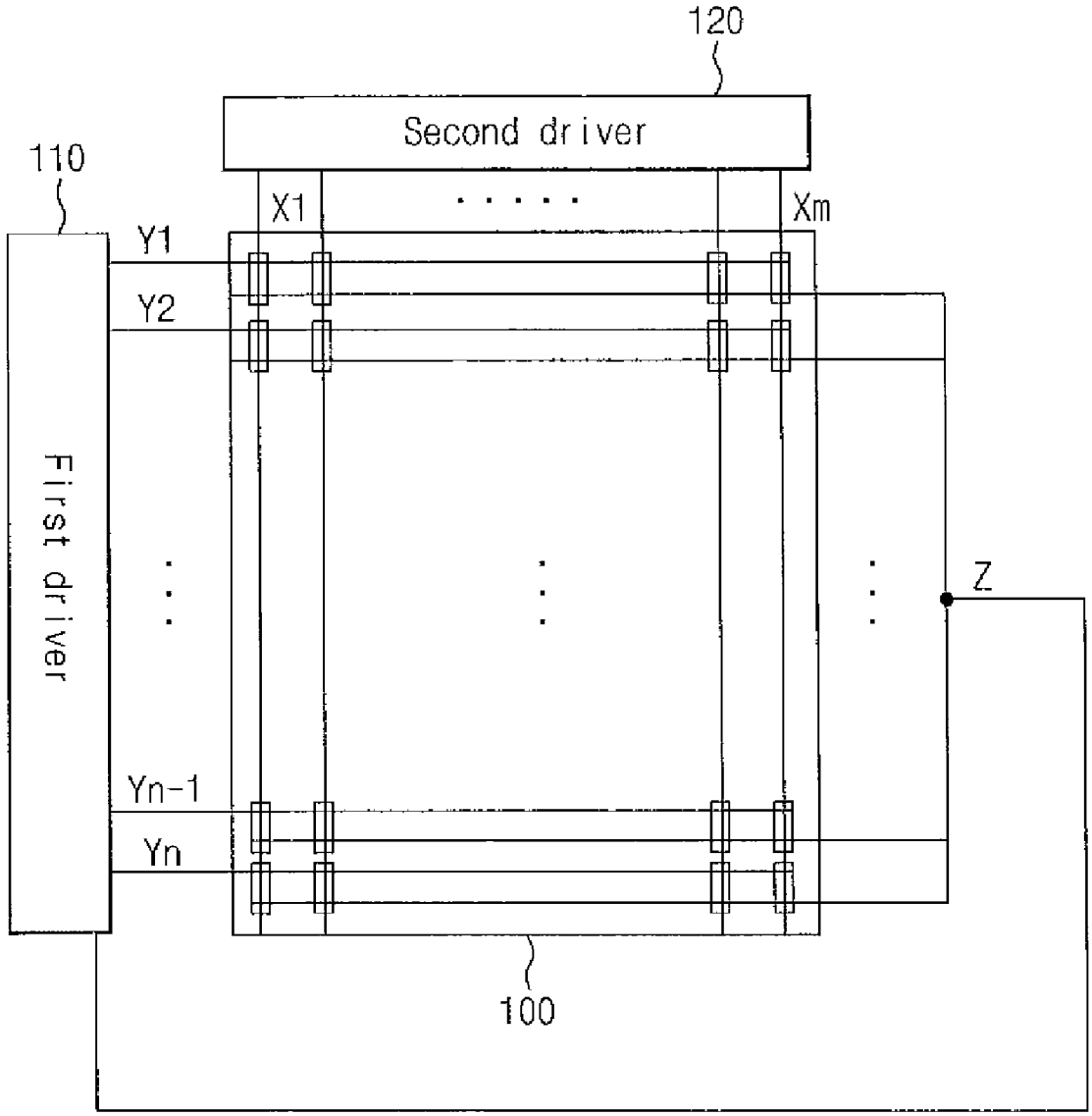
FIG. 1 illustrates a plasma display apparatus according to an exemplary embodiment.

FIG. 1 illustrates a plasma display apparatus according to an exemplary embodiment.

As illustrated in FIG. 1, the plasma display apparatus according to an exemplary embodiment includes a plasma display panel 100 including first electrodes Y1 to Yn, second electrodes Z, and third electrodes X1 to Xm, a first driver 110, and a second driver 120.

The first electrodes Y1 to Yn are electrically connected to the first driver 110, the second electrodes Z are electrically connected to a reference voltage source, and the third electrodes X1 to Xm are electrically connected to the second driver 120. The reference voltage source may supply a ground level voltage.

The first and second drivers 110 and 120 supply predetermined driving voltages to the plurality of electrodes of the plasma display panel 100 during several subfields of one frame.

The first driver 110 drives the first electrodes Y1 to Yn. The first electrodes Y1 to Yn may be a scan electrode, and the second electrodes Z may be a sustain electrode.

One terminal of the first driver 110 is electrically connected to the first electrodes Y1 to Yn, and the other terminal is electrically connected to the reference voltage source.

The first driver 110 supplies a reset signal to the first electrodes Y1 to Yn during a reset period, thereby initializing wall charges inside discharge cells. Further, the first driver 110 supplies a scan signal to the first electrodes Y1 to Yn during an address period, and supplies a sustain signal to the first electrodes Y1 to Yn during a sustain period to display an image on the plasma display panel 100.

The first driver 110 includes a negative voltage controller, a sustain driver, and a negative voltage blocking unit.

The negative voltage controller supplies a negative voltage output from a negative constant voltage source to the first electrodes Y1 to Yn, and one terminal of the sustain driver is connected to one terminal of the negative voltage controller. The negative constant voltage source supplies the lowest voltage of the scan signal during the address period.

The negative voltage controller includes for a set-down controller that supplies a set-down signal to the first electrodes Y1 to Yn during a set-down period, and a scan signal controller that supplies a scan signal of a negative polarity to the first electrodes Y1 to Yn during the address period.

The negative voltage blocking unit blocks the formation of a current path passing from the negative voltage controller through the sustain driver toward the reference voltage source while the negative voltage controller supplies the negative voltage to the first electrodes Y1 to Yn.

A sustain driver supplies a sustain signal to the first electrodes Y1 to Yn. The highest voltage and the lowest voltage of the sustain signal may be a positive sustain voltage and a negative sustain voltage, respectively.

The second driver 120 supplies a data signal to the third electrodes X1 to Xm.

Figure 2:
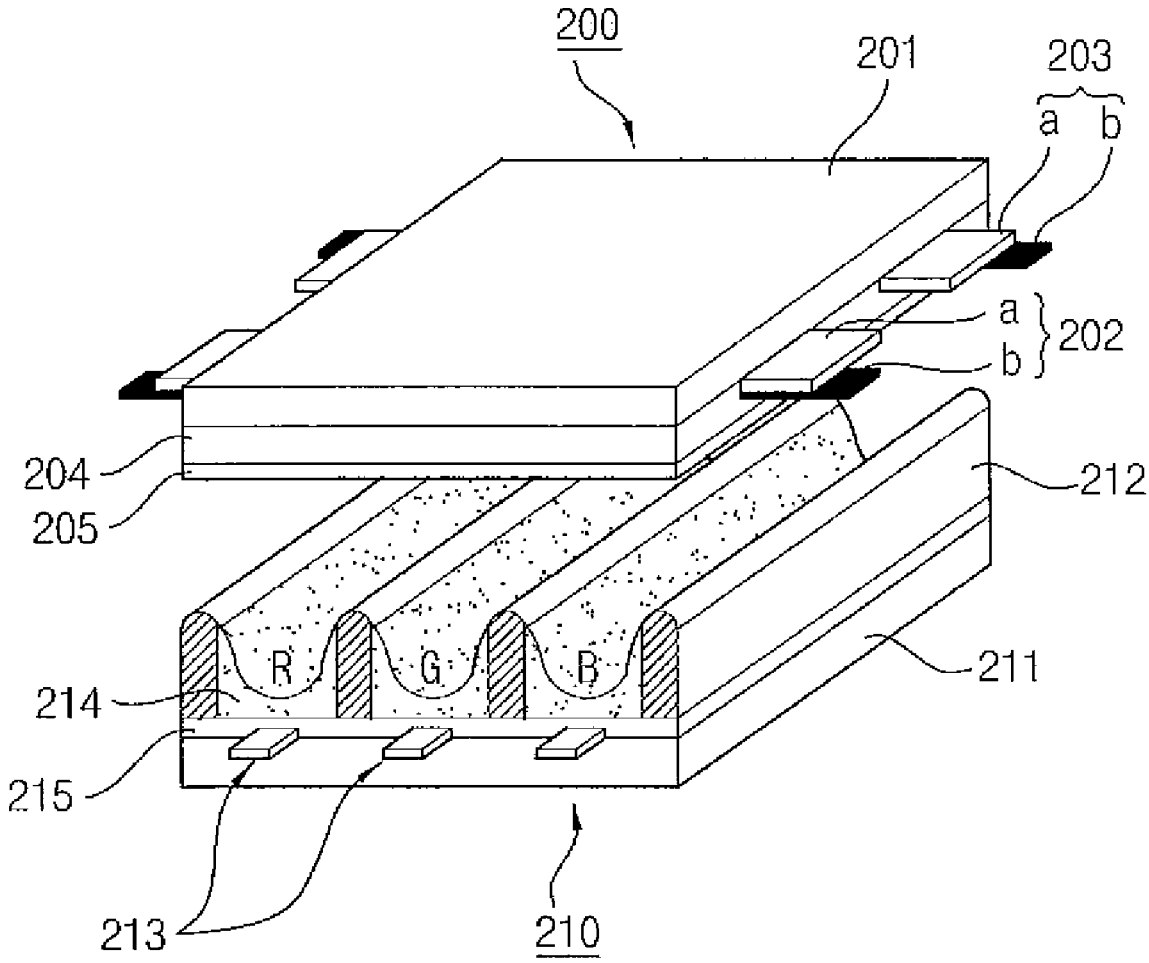
FIG. 2 illustrates a structure of a plasma display panel of FIG. 1.

FIG. 2 illustrates a structure of a plasma display panel of FIG. 1.

As illustrated in FIG. 2, the plasma display panel 100 includes a front panel 200 and a rear panel 210 which are coupled in parallel to oppose to each other at a given distance therebetween. The front panel 200 includes a front substrate 201 being a display surface on which an image is displayed. The rear panel 210 includes a rear substrate 211 constituting a rear surface. A plurality of first electrodes 202 and a plurality of second electrodes 203 are formed in pairs on the front substrate 201. A plurality of third electrodes 213 are arranged on the rear substrate 211 to intersect the first electrodes 202 and the second electrodes 203.

The first electrode 202 and the second electrode 203 each include transparent electrodes 202*a* and 203*a* made of a transparent material such as indium-tin-oxide (ITO) and bus electrodes 202*b* and 203*b* made of a metal material. The first electrode 202 and the second electrode 203 generate a mutual discharge therebetween in one discharge cell and maintain light-emissions of the discharge cells. The first electrode 202 and the second electrode 203 are covered with one or more upper dielectric layers 204 for limiting a discharge current and providing electrical insulation between the first electrode 202 and the second electrode 203. A protective layer 205 with a deposit of MgO is formed on an upper surface of the upper dielectric layer 204 to facilitate discharge conditions.

A plurality of stripe-type (or well-type) barrier ribs 212 are formed in parallel on the rear substrate 211 to form a plurality of discharge spaces (i.e., a plurality of discharge cells). The plurality of third electrodes 213 for performing an address discharge to generate vacuum ultraviolet rays are arranged in parallel to the barrier ribs 212. An upper surface of the rear substrate 211 is coated with red (R), green (G) and blue (B) phosphors 214 for emitting visible light for an image display during the generation of an address discharge. A lower dielectric layer 215 is formed between the third electrodes 213 and the phosphors 214 to protect the third electrodes 213.

FIG. 2 illustrated only an example of the plasma display panel 100 applicable to an exemplary embodiment. Accordingly, an exemplary embodiment is not limited to the structure of the plasma display panel illustrated in FIG. 2.

For instance, in FIG. 2, the first electrode 202 and the second electrode 203 each include the transparent electrodes 202*a* and 203*a* and the bus electrodes 202*b* and 203*b*. However, at least one of the first electrode 202 and the second electrode 203 may include only the bus electrode.

Further, FIG. 2 illustrated the upper dielectric layer 204 having a constant thickness. However, the upper dielectric layer 204 may have a different thickness and a different dielectric constant in each area. FIG. 2 illustrated the barrier ribs 212 having a constant interval between the barrier ribs. However, an interval between the barrier ribs 112 forming the blue discharge cell (B) may be larger than intervals between the barrier ribs 112 forming the red and green discharge cells (R and C).

Further, a luminance of an image displayed on the plasma display panel 100 can increase by forming the side of the barrier rib 112 in a concavo-convex shape and coating the phosphor 214 depending on the concavo-convex shape of the barrier rib 112.

A tunnel may be formed on the side of the barrier rib 112 so as to improve an exhaust characteristic when the plasma display panel is fabricated.

In case that only one of the first electrode 202 and the second electrode 203 is formed and a discharge maintaining signal is supplied to the first or second electrode and the third electrode 213, the first or second electrode and the third electrode 213 may be a sustain electrode. FIG. 2 illustrated a case where the plasma display panel includes the first electrode 202, the second electrode 203 and the third electrode 213. In an exemplary embodiment, the three-electrode type plasma display panel will be described as an example.

Figure 3:
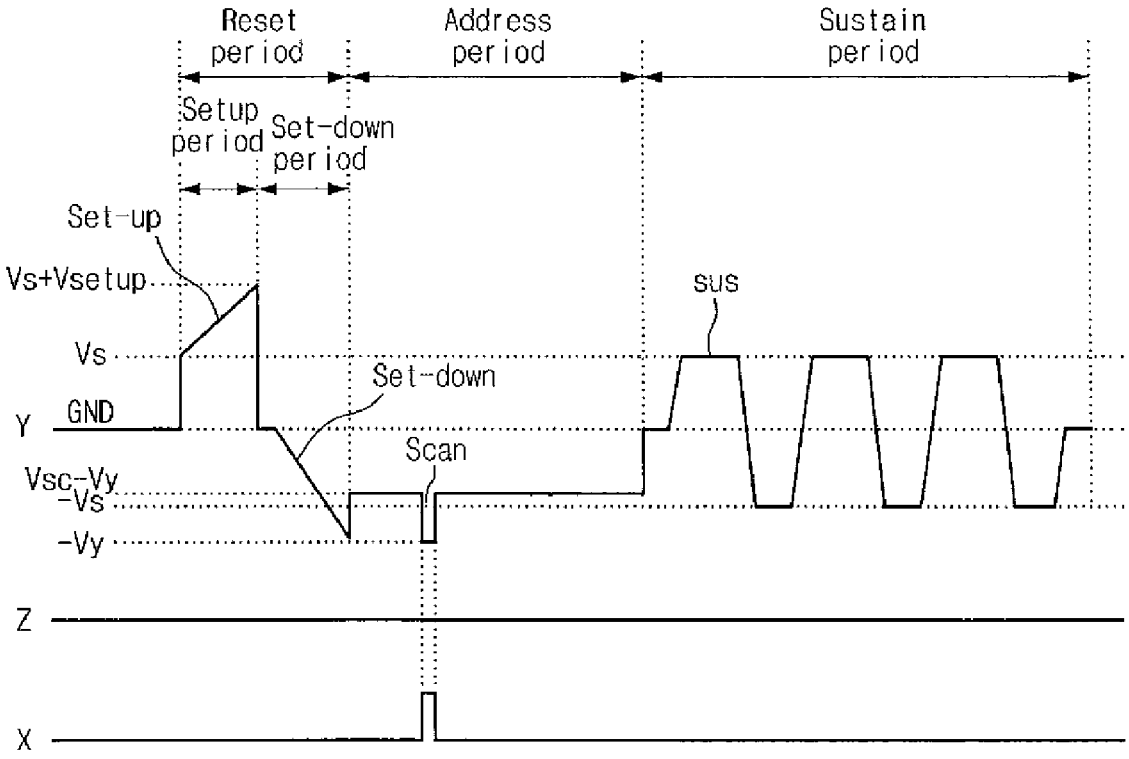
FIG. 3 illustrates a method of driving the plasma display panel.

FIG. 3 illustrates a method of driving the plasma display panel.

The first driver 110 supply driving signals to the first electrode Y and the third electrode X during at least one of a reset period, an address period, and a sustain period. Since the second electrode Z is electrically connected to the reference voltage source, the reference voltage may be supplied to the second electrode Z during a reset period, an address period and a sustain period. The reference voltage may be a ground level voltage.

The reset period is divided into a setup period and a set-down period. During the setup period, a setup controller included in the first driver 110 may supply a setup signal (Set-up) to the first electrode Y. The setup signal generates a weak dark discharge within the discharge cells of the whole screen This results in wall charges of a positive polarity being accumulated on the second electrode Z and the third electrode X, and wall charges of a negative polarity being accumulated on the first electrode Y.

During the set-down period, a set-down controller included in the first driver 110 may supply a set-down signal (Set-down), which falls to a given voltage level lower than a ground level voltage GND, to the first electrode Y, thereby generating a weak erase discharge within the discharge cells. Furthermore, the remaining wall charges are uniform inside the discharge cells to the extent that the address discharge can be stably performed.

During the address period, a scan reference voltage controller included in the first driver 110 may supply a scan bias voltage (Vsc−Vy) to the first electrode Y. A scan signal controller included in the first driver 110 may supply a scan signal (Scan) of a negative polarity falling from the scan bias voltage (Vsc−Vy) to the lowest voltage (−Vy) of the scan signal (Scan) to the first electrode Y. The second driver 120 may supply a data signal of a positive polarity in synchronization with the scan signal (Scan) to the third electrode X. As a voltage difference between the scan signal (Scan) and the data signal is added to the wall voltage generated during the reset period, an address discharge is generated within the discharge cells to which the data signal is applied. Wall charges are formed inside the discharge cells selected by performing the address discharge to the extent that a discharge occurs whenever a sustain voltage Vs is applied.

During the sustain period, the sustain driver included in the first driver 110 may supply a sustain signal (sus) to the first electrode Y.

The second electrode Z electrically connected to the reference voltage source is maintained at a voltage level equal to a reference voltage output from the reference voltage source. The reference voltage source supplies a ground level voltage.

As the wall voltage inside the discharge cells selected by performing the address discharge is added to the sustain signal (sus), every time the sustain signal (sus) is applied, a sustain discharge, i.e., a display discharge is generated between the first electrode Y and the second electrode Z.

An erase period may be added in an exemplary embodiment.

FIG. 3 illustrated only an example of the driving signals. Accordingly, a scan bias voltage higher than the ground level voltage (GND) may be supplied instead of the scan bias voltage lower than the ground level voltage (GND).

Figure 4A:
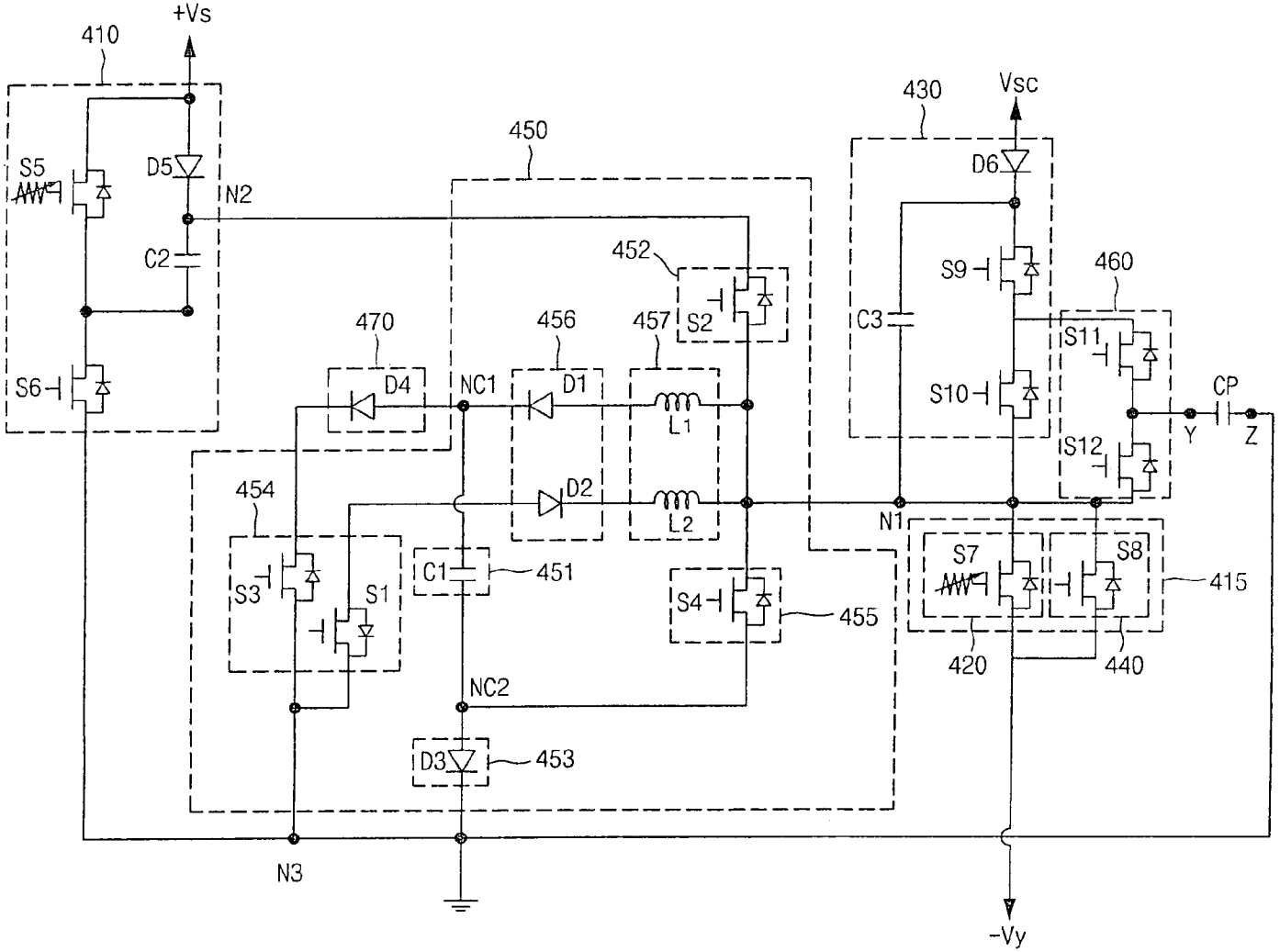
FIGS. 4A and 4B illustrates a first driver of the plasma display apparatus of FIG. 1.
Figure 4B:
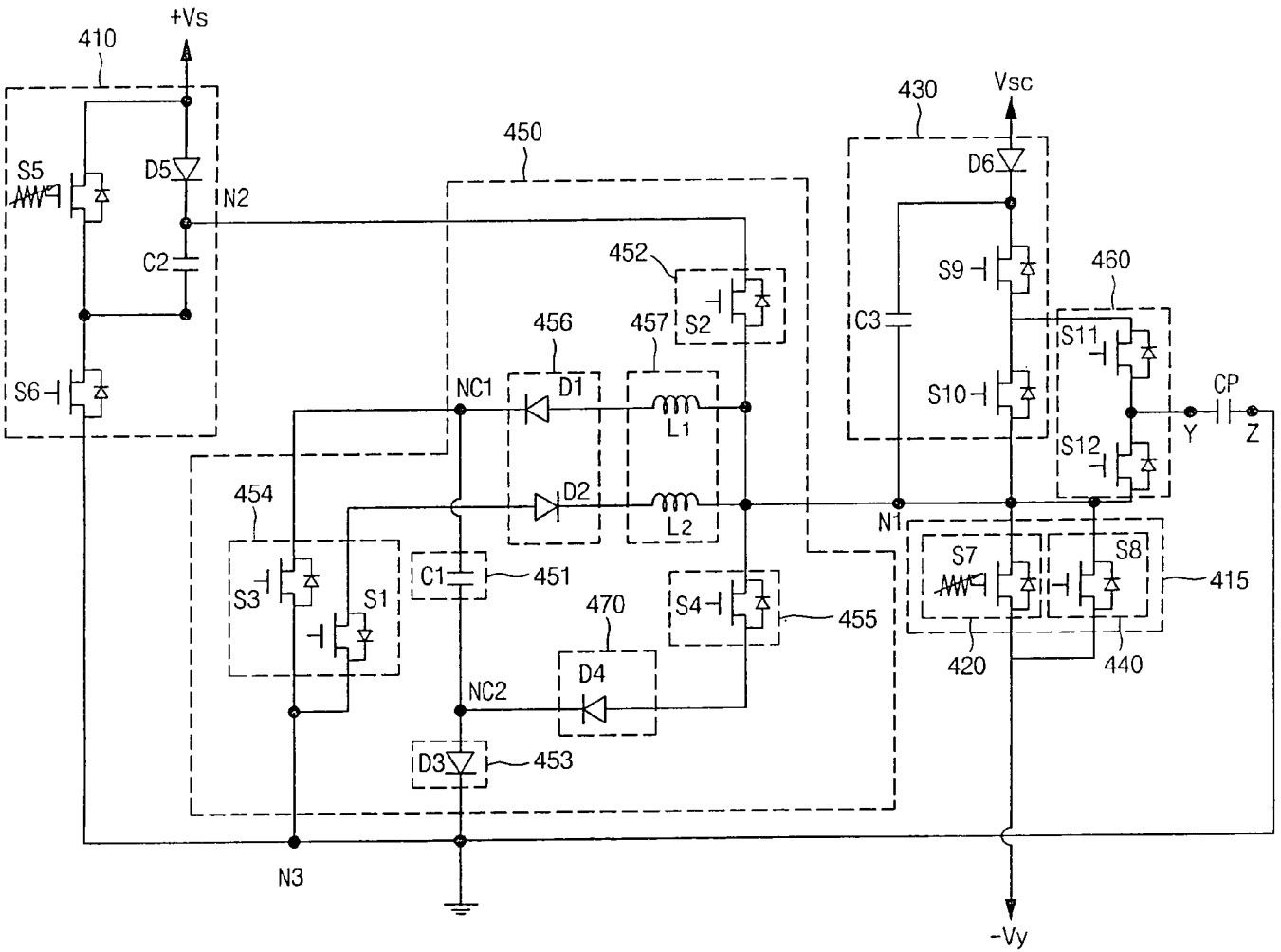

FIGS. 4A and 4B illustrates a first driver of the plasma display apparatus of FIG. 1.

As illustrated in FIG. 4A, the first driver 110 includes a setup controller 410, a negative voltage controller 415, a scan reference voltage controller 430, a sustain driver 450, a driving signal output unit 460, and a negative voltage blocking unit 470. The negative voltage controller 415 includes a set-down controller 420 and a scan signal controller 440.

The setup controller 410 supplies a setup signal, that gradually rises from a first voltage to a voltage level equal to two times a magnitude of the first voltage, to the first electrode Y. In an exemplary embodiment, the first voltage is output from a sustain voltage source (+Vs).

The setup controller 410 includes a fifth switch S5, a sixth switch S6, a fifth diode D5, and a second capacitor C2.

One terminal of the fifth switch S5 is connected to the sustain voltage source (+Vs), and the other terminal is connected to one terminal of the sixth switch S6. The other terminal of the sixth switch S6 is connected to a third node N3.

One terminal of the fifth diode D5 is commonly connected to the sustain voltage source (+Vs) and one terminal of the fifth switch S5, and the other terminal is commonly connected to one terminal of the second capacitor C2 and a second node N2. The other terminal of the second capacitor C2 is commonly connected to one terminal of the sixth switch S6 and the other terminal of the fifth switch S5.

When the sixth switch S6 is turned on, a current path for charging the second capacitor C2 is formed. Hence, a voltage at the second node N2 is +Vs. The fifth switch S5 changes a voltage output from the sustain voltage source (+Vs) In other words, when the sixth switch S6 is turned off and the fifth switch S5 operated in an active area is turned on, a voltage at the third node N3 gradually rises from the ground level voltage (GND) to +Vs. Therefore, a voltage at the node N2 gradually rises from +Vs to +2Vs. A voltage Vsetup of FIG. 3 may be substantially equal to +Vs. The setup signal (Set-up) gradually rising to +2Vs is supplied to the first electrode Y through a first sustain switch S2 and the driving signal output unit 460 during the setup period.

The sixth switch S6 is continuously turned on except a period of time during which the setup signal (Set-up) is supplied to the first electrode Y. A voltage at the second node N2 is maintained at a voltage +Vs during a period of time when the sixth switch S6 is turned on.

The set-down controller 420 includes a seventh switch S7. One terminal of the seventh switch S7 is connected to the first node N1, and the other terminal is connected to a scan voltage source (−Vy).

The seventh switch S7 changes a voltage output from the scan voltage source (−Vy), and supplies the set-down signal (Set-down) to the first electrode Y through the driving signal output unit 460 during the set-down period. When the seventh switch S7 operated in an active area is turned on, the set-down signal (Set-down) gradually falling to a voltage output from the scan voltage source (−Vy) is supplied to the first electrode Y. The plasma display apparatus according to an exemplary embodiment may further include a ground level voltage switch connected between the second electrode Z and the reference voltage source (GND). A current path may be formed in response to a turn on operation of the ground level voltage switch.

The scan reference voltage controller 430 includes a third capacitor C3, a ninth switch S9, a tenth switch S10, and a sixth diode D6.

One terminal of the sixth diode D6 is connected to a scan reference voltage source (Vsc), and the other terminal is connected to one terminal of the third capacitor C3. The other terminal of the third capacitor C3 is connected to the first node N1.

One terminal of the ninth switch S9 is commonly connected to the other terminal of the sixth diode D6 and one terminal of the third capacitor C3, and the other terminal is connected to one terminal of the tenth switch S10.

The scan reference voltage controller 430 supplies the scan bias voltage (Vsc−Vy) to the first electrode Y through the driving signal output unit 460 due to operations of the third capacitor C3 and the ninth switch S9 during the address period. In other words, the third capacitor C3 is charged to the scan reference voltage (Vsc). When the negative scan voltage (−Vy) is supplied to the third capacitor C3 through the first node N1 due to a turn on operation of an eighth switch S8 of the scan signal controller 440 that will be described below, the scan bias voltage (Vsc−Vy) is supplied to the first electrode Y through the turned-on ninth switch S9. At this time, the tenth switch S10 is turned off.

The scan signal controller 440 includes the eighth switch S8. One terminal of the eighth switch S8 is connected to the first node N1, and the other terminal is commonly connected to the scan voltage source (−Vy) and the other terminal of the seventh switch S7.

When the eighth switch S8 is turned on during the address period, the scan signal falling from the scan bias voltage (Vsc−Vy) to the negative scan voltage (−Vy) is supplied to the first electrode Y through the driving signal output unit 460. At this time, the ninth switch is turned off and the tenth switch S10 is turned on.

The driving signal output unit 460 includes an eleventh switch S11 and a twelfth switch S12. One terminal of the eleventh switch S11 is commonly connected to the ninth switch S9 and the tenth switch S10, and the other terminal is commonly connected to one terminal of the twelfth switch S12 and the first electrode Y. The other terminal of the twelfth switch S12 is connected to the first node N1.

The driving signal output unit 460 supplies the signals output from the setup controller 410, the set-down controller 420, the scan reference voltage controller 430, the scan signal controller 440, and the sustain driver 450 to the first electrode Y through the eleventh switch S11 or the twelfth switch S12.

The sustain driver 450 includes a capacitor unit 451, a first sustain controller 452, a voltage maintenance unit 453, a resonance controller 454, a second sustain controller 455, a reverse current blocking unit 456, and an inductor unit 457. The sustain driver 450 supplies the first voltage to the first electrode Y and one terminal of a first capacitor Cl of the capacitor unit 451, and supplies a second voltage of the other terminal of the first capacitor C1 to the second electrode Z. The second voltage is lower than the first voltage. The first voltage and the second voltage may have different polarities and a substantially equal voltage magnitude.

The capacitor unit 451 includes the first capacitor C1 for charging a voltage output from the sustain voltage source (+Vs).

The first sustain controller 452 includes a first sustain switch S2. The first sustain controller 452 supplies the first voltage output from the sustain voltage source (+Vs) to the first electrode Y, and at the same time, supplies the first voltage to one terminal of the first capacitor C1. One terminal of the first sustain switch S2 is connected to the second node N2, and the other terminal is commonly connected to the first node N1 and the inductor unit 457.

When the first sustain switch S2 is turned on, a current path passing through the sustain voltage source (+Vs), the first sustain switch S2, a first inductor L1, a first diode D1, the first capacitor C1, and the third diode D3 is formed, and a current path passing through the sustain voltage source (+Vs), the first sustain switch S2, and the second electrode Z is formed.

The voltage maintenance unit 453 includes a third diode D3. The voltage maintenance unit 453 blocks the current flow from a cathode terminal of the third diode D3 into an anode terminal of the third diode D3 so that a voltage charged to the first capacitor C1 is maintained. One terminal of the third diode D3 is commonly connected to the first capacitor C1 and a second sustain switch S4 of the second sustain controller 455, and the other terminal is connected to the third node N3.

The resonance controller 454 swings a voltage level of the first electrode Y between the first voltage (+Vs) and the second voltage (−Vs) or between the second voltage (−Vs) and the first voltage (+Vs) through resonance between the resonance controller 454 and the plasma display panel Cp.

The resonance controller 454 includes a first resonance switch S3 operated so that a voltage level of the first electrode changes from the first voltage (+Vs) to the second voltage (−Vs) through resonance, and a second resonance switch S1 operated so that a voltage level of the first electrode changes from the second voltage (−Vs) to the first voltage (+Vs) through resonance.

The second sustain controller 455 includes the second sustain switch S4. The second sustain controller 455 supplies the second voltage of the other terminal of the first capacitor C1 to the first electrode Y to maintain a voltage level of the first electrode Y at the second voltage. One terminal of the second sustain switch S4 is commonly connected to the inductor unit 457 and the first node N1, and the other terminal is commonly connected to one terminal of the voltage maintenance unit 453 and the first capacitor C1.

The inductor unit 457 includes a first inductor L1 and a second inductor L2. The first inductor L1 and the plasma display panel Cp generate resonance so that a voltage level of the first electrode Y changes from the first voltage (+Vs) to the second voltage (−Vs). The second inductor L2 and the plasma display panel Cp generate resonance so that a voltage level of the first electrode Y changes from the second voltage (−Vs) to the first voltage (+Vs).

The reverse current blocking unit 456 is electrically connected to the inductor unit 457 and the resonance controller 454 to block a reverse current.

The reverse current blocking unit 456 includes a first diode D1 and a second diode D2. The first diode D1 blocks the current flow from the first resonance switch S3 into the first inductor L1, and the second diode D2 blocks the current flow from the second inductor L2 into the second resonance switch S1.

An operation of the sustain driver 450 will be described in detail below.

As described above, the first voltage (Vs) is supplied to the first electrode Y and the first capacitor C1 is charged to the first voltage (Vs) due to a turn-on operation of the first sustain switch S2.

When the second resonance switch S1 and the twelfth switch S12 are turned on, a current path passing through the first electrode Y, the first inductor L1, the first diode D1, the first resonance switch S, and the second electrode Z is formed. Hence, resonance occurs between the first inductor L1 and the panel Cp. Before a turn-on operation of the second resonance switch S1, a voltage level of the first electrode Y gradually falls from the first voltage (+Vs) to the second voltage (−Vs).

Since both terminals of the first capacitor C1 do not participate in the formation of a current path due to the third diode D3, a voltage between both terminals of the first capacitor C1 is maintained at the first voltage (+Vs).

When a voltage level of the first electrode Y falls to the second voltage (−Vs), a voltage at a node NC1 is a ground level voltage due to the turned-on first resonance switch S3.

Accordingly, a voltage at a node NC2 is the second voltage (−Vs) and a voltage at the third node N3 is the ground level voltage so that a voltage difference between both terminals of the first capacitor C1, i.e., a voltage difference between the node NC1 and the node NC2 is maintained.

When the first resonance switch S3 remains in a turn-on state and the second sustain switch S4 is turned on, a current path passing through the first electrode Y, the second sustain switch S4, the first capacitor C1, the first resonance switch S3, and the second electrode Z is formed.

Since a voltage difference between both terminals of the first capacitor C1 is maintained, a voltage at the node NC2 is the second voltage (−Vs). The second voltage (−Vs) supplied to the node NC2 is supplied to the first electrode Y through the second sustain switch S4.

At this time, the third diode D3 blocks the current flow from the third node N3 into the node NC2. The reason is that a voltage at the third node N3 is higher than a voltage at the node NC2.

Next, the second resonance switch S1 is turned on. Hence, a current path passing through the second electrode Z, the second resonance switch S1, the second diode D2, the second inductor L2, and the first electrode Y is formed. A voltage level of the first electrode Y gradually rises from the second voltage (−Vs) to the first voltage (+Vs) through resonance between the second inductor L2 and the panel Cp.

The negative voltage blocking unit 470 includes a fourth diode D4. One terminal of the fourth diode D4 may be connected to one terminal of the first diode D1, and the other terminal may be connected to one terminal of the first resonance switch S3.

A cathode terminal of the fourth diode D4 is electrically connected to the first resonance switch S3, and an anode terminal is electrically connected to the first diode D1.

In case that the negative scan voltage (−Vy) lower than the ground level voltage is supplied to the first electrode Y through the set down controller 420 or the scan signal controller 440 (i.e., in case that a voltage at the first node N1 is lower than the ground level voltage), the negative voltage blocking unit 470 prevents the negative scan voltage (−Vy) from being supplied to the reference voltage source through a body diode of the second sustain switch S4, the other terminal (i.e., the node NC2) of the first capacitor C1, one terminal (i.e., the node NC1) of the first capacitor C1, and a body diode of the first resonance switch S3.

As illustrated in FIG. 4B, the negative voltage blocking unit 470 includes the fourth diode D4. One terminal of the fourth diode D4 may be commonly connected to one terminal of the first diode D1 and one terminal of the voltage maintenance unit 453, and the other terminal may be connected to one terminal of the second sustain controller 455.

As above, the negative voltage blocking unit 470 connected to the sustain driver 450 does not affect an operation of the sustain driver 450. In case that a voltage at the first node N1 connected to the negative voltage blocking unit 470 is lower than the ground level voltage, the negative voltage blocking unit 470 prevents a signal of a negative polarity from being supplied to the reference voltage source (GND).

Since the negative voltage blocking unit 470 includes a diode instead of a field effect transistor (FET), the fabrication cost of the plasma display apparatus is reduced.

It is possible to use the negative voltage blocking unit 470 in another sustain driver as well as the sustain driver 450 according to an exemplary embodiment. For instance, in case that general sustain drivers are connected to both terminals of the panel Cp, respectively, it is possible to use the negative voltage blocking unit 470. In this case, it is possible to use the negative voltage blocking unit 470 by connecting one terminal of the negative voltage blocking unit 470 to a ground level voltage controller, that supplying the ground level voltage to the first electrode Y of the panel Cp, and connecting the other terminal of the negative voltage blocking unit 470 to the sustain controller that supplies the positive sustain voltage to the inductor and the first electrode Y.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel including a first electrode and a second electrode connected to a reference voltage source;

a negative voltage controller that supplies a negative voltage output from a negative constant voltage source to the first electrode;

a sustain driver that supplies a sustain signal to the first electrode, one terminal of the sustain driver being connected to one terminal of the negative voltage controller; and a negative voltage blocking unit that prevents the negative voltage from being supplied to the reference voltage source through the sustain driver while the negative voltage controller supplies the negative voltage to the first electrode.

2. The plasma display apparatus of claim 1, wherein the reference voltage source supplies a ground level voltage.

3. The plasma display apparatus of claim 1, wherein the sustain driver includes a capacitor, supplies a first voltage to the first electrode and one terminal of the capacitor, and supplies a second voltage of the other terminal of the capacitor to the second electrode, and the second voltage is lower than the first voltage, and the first voltage and the second voltage have different polarities and a substantially equal voltage magnitude.

4. The plasma display apparatus of claim 1, wherein the negative voltage controller includes a set-down controller that supplies a set-down signal gradually falling to the negative voltage to the first electrode during a set-down period.

5. The plasma display apparatus of claim 1, wherein the negative voltage controller includes a scan signal controller that supplies a scan signal falling to the negative voltage to the first electrode during an address period.

6. The plasma display apparatus of claim 1, further comprising a setup controller that supplies a setup signal gradually rising from the first voltage to a voltage level equal to two times a magnitude of the first voltage to the first electrode.

7. The plasma display apparatus of claim 1, wherein the negative voltage blocking unit blocks the current flow from the other terminal of the capacitor into one terminal of the capacitor.

8. A plasma display apparatus comprising:

a plasma display panel including a first electrode and a second electrode connected to a reference voltage source;

a negative voltage controller that supplies a negative voltage output from a negative constant voltage source to the first electrode;

a first sustain controller that controls to supply a first voltage to the first electrode and one terminal of a capacitor;

an inductor unit that generates resonance between the plasma display panel and the inductor unit;

a resonance controller that swings a voltage level of the first electrode between the first voltage and a second voltage lower than the first voltage through resonance between the plasma display panel and the inductor unit;

a second sustain controller that controls to supply the second voltage of the other terminal of the capacitor to the first electrode;

a reverse current blocking unit that is electrically connected to the inductor unit and the resonance controller, and blocks a reverse current; and a negative voltage blocking unit that prevents the negative voltage supplied to the first electrode from being supplied to the reference voltage source through the capacitor.

9. The plasma display apparatus of claim 8, wherein the reference voltage source supplies a ground level voltage.

10. The plasma display apparatus of claim 8, wherein the first voltage and the second voltage have different polarities and a substantially equal voltage magnitude.

11. The plasma display apparatus of claim 8, further comprising a voltage maintenance unit that blocks a reverse current to maintain a voltage charged to the capacitor constant.

12. The plasma display apparatus of claim 8, wherein the resonance controller includes a first resonance switch operated so that a voltage level of the first electrode changes from the first voltage to the second voltage, and a second resonance switch operated so that a voltage level of the first electrode changes from the second voltage to the first voltage.

13. The plasma display apparatus of claim 8, wherein the inductor unit includes a first inductor that generates resonance between the plasma display panel and the first inductor so that a voltage level of the first electrode changes from the first voltage to the second voltage, and a second inductor that generates resonance between the plasma display panel and the second inductor so that a voltage level of the first electrode changes from the second voltage to the first voltage.

14. The plasma display apparatus of claim 8, wherein the reverse current blocking unit includes a first diode that blocks the current flow from the inductor unit into the first electrode, and a second diode that blocks the current flow from the first electrode into the inductor unit.

15. The plasma display apparatus of claim 8, wherein the negative voltage blocking unit includes a diode having an anode terminal connected to one terminal of the capacitor.

16. The plasma display apparatus of claim 8, wherein the negative voltage blocking unit includes a diode having a cathode terminal connected to the other terminal of the capacitor.

* * * * *